US005884514A

United States Patent [19]

Willis

[11] Patent Number: 5,884,514

[45] Date of Patent: Mar. 23, 1999

[54] KEY AND ALARM REMOTE STABILIZING DEVICE

[76] Inventor: Earnest Willis, 4315 Don Tomaso Dr. #26, Los Angeles, Calif. 90008

[21] Appl. No.: 15,203

[22] Filed: Jan. 29, 1998

[51] Int. Cl.[6] ..... A47G 29/10

[52] U.S. Cl. ..... 70/456 R; 70/456 B; 70/54; 70/457

[58] Field of Search ..... 70/54–56, 456 R, 70/456 B, 457, 458, 460, 408

[56] References Cited

U.S. PATENT DOCUMENTS

| | | | |
|---|---|---|---|
| 946,119 | 1/1910 | Field | 70/456 R |
| 1,646,987 | 10/1927 | Benham | 70/460 X |
| 2,066,526 | 1/1937 | Gaadstone | 70/456 R |
| 2,086,378 | 7/1937 | Butler | 70/456 R |
| 3,119,429 | 1/1964 | Stiller et al. | 70/457 X |
| 3,326,258 | 6/1967 | Stucker | 70/456 R |
| 3,613,416 | 10/1971 | Paton | 70/456 R |
| 3,968,669 | 7/1976 | Coleman | 70/457 X |
| 4,072,033 | 2/1978 | Eckerdt | 70/456 B |
| 4,166,489 | 9/1979 | Lemelson | 70/456 R X |
| 4,359,888 | 11/1982 | Scheineman | 70/457 |
| 4,939,917 | 7/1990 | Cartwright | 70/456 R |
| 5,069,050 | 12/1991 | Chen | 70/456 R |
| 5,550,529 | 8/1996 | Burge | 70/460 X |
| 5,561,331 | 10/1996 | Suyama et al. | 70/456 R X |

FOREIGN PATENT DOCUMENTS

| | | | |
|---|---|---|---|
| 1222789 | 1/1959 | France | 70/456 B |
| 1527145 | 4/1968 | France | 70/456 B |

*Primary Examiner*—Suzanne Dino Barrett

[57] ABSTRACT

A new key and alarm remote stabilizing device for helping prevent keys and auto remote control devices from banging against a steering column when a key is in the ignition. The inventive device includes a main panel with a ring panel coupled to the top end of the main panel. The back surface of the ring panel is designed for mounting to a vehicular surface such that a locking ignition switch on the vehicular surface extends through the central hole of the ring panel. The outer perimeter of a top panel is coupled to the lower portion outer perimeter of the lower portion of the main panel to form a pocket between the top panel and the main panel. The top edge of the top panel defines an opening into the pocket so that objects may be inserted therein.

8 Claims, 2 Drawing Sheets

KEY AND ALARM REMOTE STABILIZING DEVICE

BACKGROUND OF THE INVENTION

1. Field of the Invention

The present invention relates to key holding devices and more particularly pertains to a new key and alarm remote stabilizing device for helping prevent keys and auto remote control devices from banging against a steering column when a key is in the ignition.

2. Description of the Prior Art

The use of key holding devices is known in the prior art. More specifically, key holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art key holding devices include U.S. Pat. No. 5,181,605; U.S. Pat. No. 4,403,488; U.S. Pat. No. 4,310,040; U.S. Pat. No. Des. 322,720; U.S. Pat. No. 4,166,489; and U.S. Pat. No. 4,598,562.

While these devices fulfill their respective, particular objectives and requirements, the aforementioned patents do not disclose a new key and alarm remote stabilizing device. The inventive device includes a main panel with a ring panel coupled to the top end of the main panel. The back surface of the ring panel is designed for mounting to a vehicular surface such that a locking ignition switch on the vehicular surface extends through the central hole of the ring panel. The outer perimeter of a top panel is coupled to the lower portion outer perimeter of the lower portion of the main panel to form a pocket between the top panel and the main panel. The top edge of the top panel defines an opening into the pocket so that objects may be inserted therein.

In these respects, the key and alarm remote stabilizing device according to the present invention substantially departs from the conventional concepts and designs of the prior art, and in so doing provides an apparatus primarily developed for the purpose of helping prevent keys and auto remote control devices from banging against a steering column when a key is in the ignition.

SUMMARY OF THE INVENTION

In view of the foregoing disadvantages inherent in the known types of key holding devices now present in the prior art, the present invention provides a new key and alarm remote stabilizing device construction wherein the same can be utilized for helping prevent keys and auto remote control devices from banging against a steering column when a key is in the ignition.

The general purpose of the present invention, which will be described subsequently in greater detail, is to provide a new key and alarm remote stabilizing device apparatus and method which has many of the advantages of the key holding devices mentioned heretofore and many novel features that result in a new key and alarm remote stabilizing device which is not anticipated, rendered obvious, suggested, or even implied by any of the prior art key holding devices, either alone or in any combination thereof.

To attain this, the present invention generally comprises a main panel with a ring panel coupled to the top end of the main panel. The back surface of the ring panel is designed for mounting to a vehicular surface such that a locking ignition switch on the vehicular surface extends through the central hole of the ring panel. The outer perimeter of a top panel is coupled to the lower portion outer perimeter of the lower portion of the main panel to form a pocket between the top panel and the main panel. The top edge of the top panel defines an opening into the pocket so that objects may be inserted therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new key and alarm remote stabilizing device apparatus and method which has many of the advantages of the key holding devices mentioned heretofore and many novel features that result in a new key and alarm remote stabilizing device which is not anticipated, rendered obvious, suggested, or even implied by any of the prior art key holding devices, either alone or in any combination thereof.

It is another object of the present invention to provide a new key and alarm remote stabilizing device which may be easily and efficiently manufactured and marketed.

It is a further object of the present invention to provide a new key and alarm remote stabilizing device which is of a durable and reliable construction.

An even further object of the present invention is to provide a new key and alarm remote stabilizing device which is susceptible of a low cost of manufacture with regard to both materials and labor, and which accordingly is then susceptible of low prices of sale to the consuming public, thereby making such key and alarm remote stabilizing device economically available to the buying public.

Still yet another object of the present invention is to provide a new key and alarm remote stabilizing device which provides in the apparatuses and methods of the prior art some of the advantages thereof, while simultaneously overcoming some of the disadvantages normally associated therewith.

Still another object of the present invention is to provide a new key and alarm remote stabilizing device for helping prevent keys and auto remote control devices from banging against a steering column when a key is in the ignition.

Yet another object of the present invention is to provide a new key and alarm remote stabilizing device which includes a main panel with a ring panel coupled to the top end of the main panel. The back surface of the ring panel is designed for mounting to a vehicular surface such that a locking ignition switch on the vehicular surface extends through the central hole of the ring panel. The outer perimeter of a top panel is coupled to the lower portion outer perimeter of the lower portion of the main panel to form a pocket between the top panel and the main panel. The top edge of the top panel defines an opening into the pocket so that objects may be inserted therein.

Still yet another object of the present invention is to provide a new key and alarm remote stabilizing device that helps prevent keys and other objects on a key chain from banging into the steering column and dash board of a vehicle so to help prevent damage to the objects and to the parts of the vehicle.

Even still another object of the present invention is to provide a new key and alarm remote stabilizing device that helps relieve the weight hanging on the ignition lock from dangling keys.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
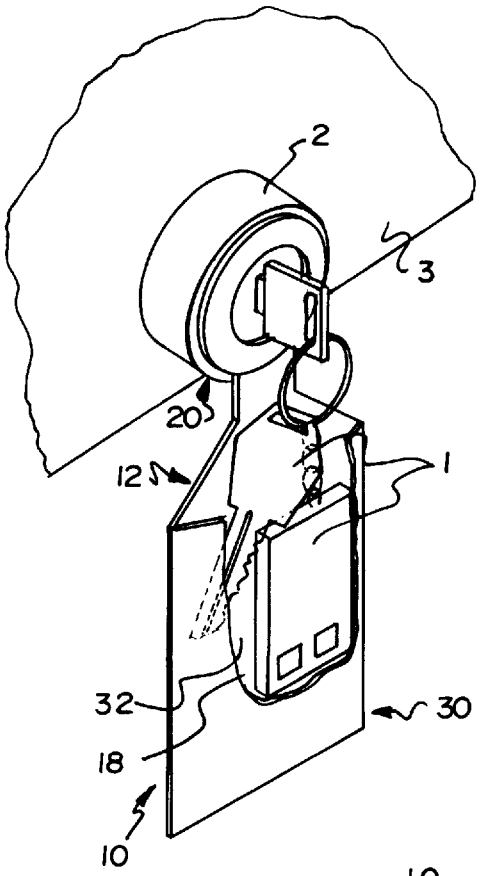
FIG. 1 is a schematic perspective view of a new key and alarm remote stabilizing device in use according to the present invention.

With reference now to the drawings, and in particular to FIGS. 1 through 4 thereof, a new key and alarm remote stabilizing device embodying the principles and concepts of the present invention and generally designated by the reference numeral 10 will be described.

The stabilizing device is designed for stabilizing objects 1 on a key chain, such as keys and remote controls for vehicular alarm devices, by mounting the device to a vehicular surface, such as a steering column 3, having a locking ignition switch 2. As best illustrated in FIGS. 1 through 4, the key and alarm remote stabilizing device 10 generally comprises a main panel 12 with a ring panel 20 coupled to the top end 13 of the main panel 12. The back surface of the ring panel 20 is designed for mounting to a vehicular surface such that a locking ignition switch 2 on the vehicular surface extends through the central hole of the ring panel 20. The outer perimeter of a top panel 30 is coupled to the lower portion outer perimeter of the lower portion 18 of the main panel 12 to form a pocket 32 between the top panel 30 and the main panel 12. The top edge 31 of the top panel 30 defines an opening into the pocket 32 so that objects 1 may be inserted therein.

Figure 2:
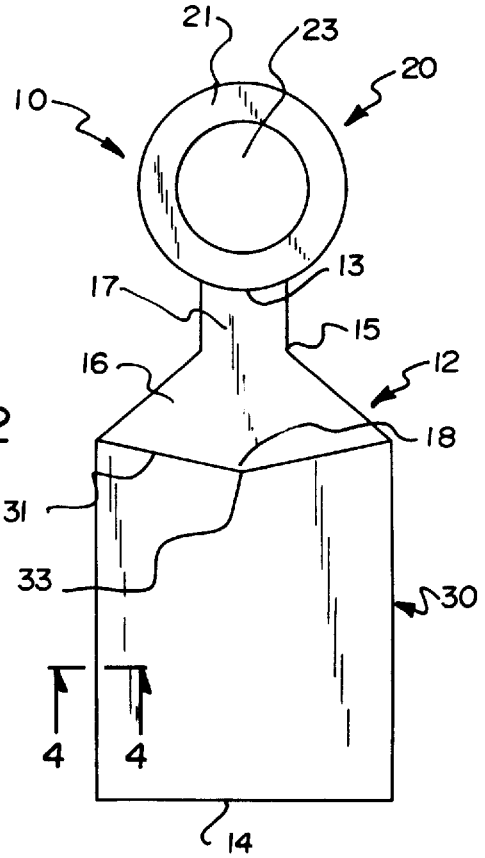
FIG. 2 is a schematic front side view of the present invention.
Figure 3:
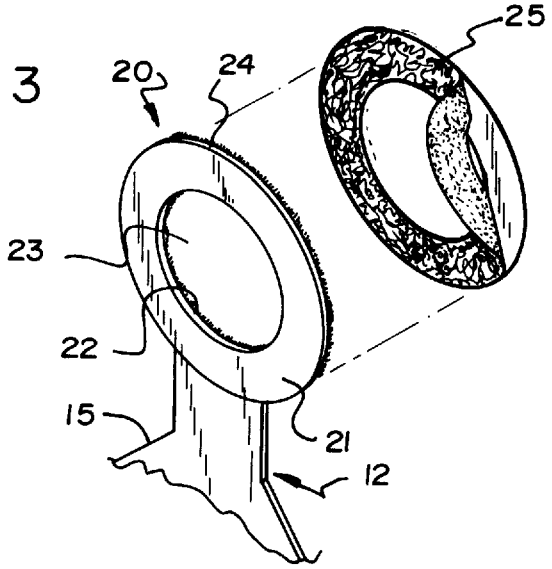
FIG. 3 a schematic partial perspective view of the ring panel of the present invention.
Figure 4:
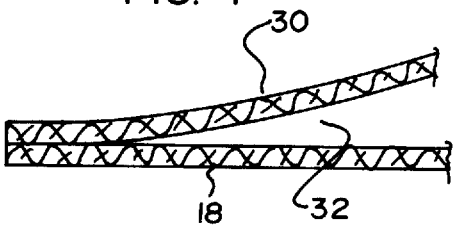
FIG. 4 is a schematic cross-sectional view of the present invention taken from line 4—4 of FIG. 2.

With reference to FIGS. 1 and 2, the main panel 12 has front and back surfaces, top and bottom ends 13,14, and upper and lower portion 15,18. The upper portion 15 of the main panel 12 is positioned towards the top end 13 of the main panel 12 while the lower portion 18 of the main panel 12 is positioned towards the bottom end 14 of the main panel 12. Ideally, the main panel 12 has a length defined between the top and bottom ends 13,14 of the main panel 12 of less than about 5 inches.

The lower portion 18 of the main panel 12 is preferably generally rectangular having a pair of opposite sides. The sides of the lower portion 18 and the bottom end 14 of the main panel 12 define a lower portion outer perimeter while the sides of the lower portion 18 of the main panel 12 define a lower portion width therebetween. Ideally the lower portion width is less than about 3 inches. In the preferred embodiment, the upper portion 15 of the main panel 12 tapers from the lower portion 18 of the main panel 12 towards top end 13 of the main panel 12 such that the upper portion 15 of the main panel 12 has a generally triangular tapered region 16 and a generally rectangular tab region 17 with the tab region 17 positioned adjacent the top end 13 of the main panel 12. The tab region 17 has a pair of opposite sides which define a tab width therebetween.

The ring panel 20 has outer and inner perimeters, and front and back surfaces 21,22. The inner perimeter defines a central hole 23. The ring panel 20 is coupled to the top end 13 of the main panel 12 and is preferably generally coplanar with the main panel 12. Preferably the ring panel 20 is generally circular with generally circular inner and outer perimeters each having their own diameter. Preferably, the diameter of the inner perimeter of the ring panel 20 is less than the tab width. In the ideal embodiment, the diameter of the outer perimeter of the ring panel 20 is also less than the lower portion width. The back surface 22 of the ring panel 20 is designed for mounting to a vehicular surface, such as a steering column 3, so that a locking ignition switch 2 on the vehicular surface 3 extends through the central hole 23 of the ring panel 20. Preferably, a portion of a hook and loop fastener 24 is provided on the back surface of the ring panel 20 to permit detachable mounting of the ring panel 20 to a complementary portion 25 of a hook and lock fastener provided on a vehicular surface 3.

The top panel 30 is preferably generally rectangular and has an outer perimeter defining top and bottom edges and a pair of side edges. The outer perimeter of the top panel 30 is coupled to the lower portion 18 outer perimeter of the lower portion 18 of the main panel 12 such that the bottom edge of the top panel 30 is coupled to the bottom end 14 of the main panel 12 and the side edges of the top panel 30 are coupled to their corresponding sides of the lower portion 18 of the main panel 12. This coupling of the top panel 30 and the main panel forms a pocket 32 between them with the top edge 31 of the top panel 30 defining an opening into the pocket 32. The pocket 32 is designed for inserting objects 1 therein, such as keys and remote controllers dangling from a key in the ignition switch 2 of a vehicle. Optionally, the top edge 31 of the top panel 30 is V-shaped with the vertex 33 of the V-shaped top edge 31 extending towards the bottom edge of the top panel 30. The V-shaped top edge 31 of the top panel 30 is designed for aiding insertion of objects 1 into the pocket 32.

Preferably, the main panel 12, the top panel 30 and the ring panel 20 are generally flexible. Ideally, wherein the main panel 12, the ring panel 20 and the top panel are constructed from a flexible vinyl or leather.

In use, ring panel 20 is mounted to a vehicular surface such that the ignition switch extends into the central hole 23. When a key is inserted into the ignition, the rest of the objects 1 on the key chain may be inserted into the pocket 32 so that they cannot swing freely while the vehicle is being driven.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stabilizing device for objects on a key chain, such as keys and remote controls for vehicular alarm devices, for mounting to a vehicular surface having an ignition switch, said stabilizing device comprising:

a main panel having front and back surfaces, top and bottom ends, and upper and lower portions, said upper portion of said main panel being positioned towards said top end of said main panel, said lower portion of said main panel being positioned towards said bottom end of said main panel, wherein said main panel has a length being defined between said top and bottom ends of said main panel;

said lower portion of said main panel having a pair of opposite sides, said sides of said lower portion and said bottom end of said main panel defining a lower portion outer perimeter, said sides of said lower portion of said main panel defining a lower portion width therebetween;

a ring panel having outer and inner perimeters, and an annular planar front surface and an annular planar back surface both of which are generally coplanar with said main panel, said ring panel being coupled to said top end of said main panel;

said inner perimeter defining a central hole;

said back surface of said ring panel being for mounting to a vehicular surface such that a locking ignition switch on the vehicular surface extends through said central hole of said ring panel;

a top panel having an outer perimeter defining top and bottom edges and a pair of side edges, said outer perimeter of said top panel being coupled to said lower portion outer perimeter of said lower portion of said main panel such that said bottom edge of said top panel is coupled to said bottom end of said main panel and said side edges of said top panel are coupled to their corresponding sides of said lower portion of said main panel;

a pocket being formed between said top panel and said main panel, said top edge of said top panel defining an opening into said pocket, said pocket being for inserting objects therein;

said inner perimeter of the ring panel being generally circular;

a first annular hook and loop fastener mounted on said back surface of said ring panel; and a second annular hook and loop fastener with a size and shape similar to that of both the ring panel and the first hook and loop fastener, the second hook and loop fastener having an adhesive on a first surface thereof adapted for being substantially permanently adhesively attached to a steering column about the ignition switch, the second annular hook and loop fastener further having a second surface for selectively detachable mounting with the first annular hook and loop fastener for allowing the ignition switch to extend through said central hole of said ring panel and protecting said steering column from contact with any objects inserted in said pocket.

2. The device of claim 1, wherein said main panel, said top panel and said ring panel are generally flexible.

3. The device of claim 1, wherein said length of said main panel is less than about 5 inches.

4. The device of claim 1, wherein said lower portion of said main panel is generally rectangular, and wherein said top panel is generally rectangular.

5. The device of claim 1, wherein said lower portion width is less than about 3 inches.

6. The device of claim 1, wherein said upper portion of said main panel tapers from said lower portion of said main panel towards top end of said main panel such that said upper portion of said main panel has a generally triangular tapered region and a generally rectangular tab region, said tab region of said upper portion of said main panel being positioned adjacent said top end of said main panel, wherein said tab region of said upper portion of said main panel has a pair of opposite sides to define a tab width therebetween.

7. A stabilizing device for objects on a key chain, such as keys and remote controls for vehicular alarm devices, for mounting to a vehicular surface having an ignition switch, said stabilizing device comprising:

a main panel having front and back surfaces, top and bottom ends, and upper and lower portions, said main panel being generally flexible, said upper portion of said main panel being positioned towards said top end of said main panel, said lower portion of said main panel being positioned towards said bottom end of said main panel, wherein said main panel has a length being defined between said top and bottom ends of said main panel, wherein said length of said main panel is less than about 5 inches;

said lower portion of said main panel being generally rectangular and having a pair of opposite sides, said sides of said lower portion and said bottom end of said main panel defining a lower portion outer perimeter, said sides of said lower portion of said main panel defining a lower portion width therebetween, wherein said lower portion width is less than about 3 inches;

said upper portion of said main panel tapering from said lower portion of said main panel towards top end of said main panel such that said upper portion of said main panel has a generally triangular tapered region and a generally rectangular tab region, said tab region of said upper portion of said main panel being positioned adjacent said top end of said main panel, wherein said tab region of said upper portion of said main panel has a pair of opposite sides to define a tab width therebetween;

wherein said main panel comprising at least one of vinyl and leather;

a generally circular ring panel having outer and inner perimeters, and an annular planar front surface and an annular planar back surface both of which are generally coplanar with said main panel, said ring panel being coupled to said top end of said main panel, wherein said ring panel is generally coplanar with said main panel, wherein said ring panel is flexible;

said outer perimeter being generally circular, said inner perimeter being generally circular and defining a central hole, wherein said outer and inner perimeters of said ring panel each have a diameter, wherein the diameter of said inner perimeter of said ring panel is less than said tab width, wherein said diameter of said outer perimeter of said ring panel is less than said lower portion width;

a first annular hook and loop fastener mounted on said back surface of said ring panel;

a second annular hook and loop fastener with a size and shape similar to that of both the ring panel and the first hook and loop fastener, the second hook and loop fastener having an adhesive on a first surface thereof adapted for being adhesively attached to a steering column about the ignition switch, the second annular hook and loop fastener further having a second surface for detachable mounting with the first annular hook and loop fastener for allowing the ignition switch to extend through said central hole of said ring panel;

a top panel being generally rectangular having an outer perimeter defining top and bottom edges and a pair of side edges, said outer perimeter of said top panel being coupled to said lower portion outer perimeter of said lower portion of said main panel such that said bottom edge of said top panel is coupled to said bottom end of said main panel and said side edges of said top panel are coupled to their corresponding sides of said lower portion of said main panel;

a pocket being formed between said top panel and said main panel, said top edge of said top panel defining an opening into said pocket, said pocket being for inserting objects therein, wherein said top edge of said top panel is V-shaped having a vertex, wherein said vertex of said V-shaped top edge of said top panel is extended towards said bottom edge of said top panel, said V-shaped top edge of said top panel being for aiding insertion of objects into said pocket.

8. A stabilizing system for objects on a key chain, the system comprising:

a vehicle including a steering column and an ignition switch;

a main panel having front and back surfaces, top and bottom ends, and upper and lower portions, said main panel being generally flexible, said upper portion of said main panel being positioned towards said top end of said main panel, said lower portion of said main panel being positioned towards said bottom end of said main panel, wherein said main panel has a length being defined between said top and bottom ends of said main panel, wherein said length of said main panel is less than about 5 inches;

said lower portion of said main panel being generally rectangular and having a pair of opposite sides, said sides of said lower portion and said bottom end of said main panel defining a lower portion outer perimeter, said sides of said lower portion of said main panel defining a lower portion width therebetween, wherein said lower portion width is less than about 3 inches;

said upper portion of said main panel tapering from said lower portion of said main panel towards top end of said main panel such that said upper portion of said main panel has a generally triangular tapered region and a generally rectangular tab region, said tab region of said upper portion of said main panel being positioned adjacent said top end of said main panel, wherein said tab region of said upper portion of said main panel has a pair of opposite sides to define a tab width therebetween;

wherein said main panel comprising at least one of vinyl and leather;

a generally circular ring panel having outer and inner perimeters, and an annular planar front surface and an annular planar back surface both of which are generally coplanar with said main panel, said ring panel being coupled to said top end of said main panel, wherein said ring panel is generally coplanar with said main panel, wherein said ring panel is flexible;

said outer perimeter being generally circular, said inner perimeter being generally circular and defining a central hole, wherein said outer and inner perimeters of said ring panel each have a diameter, wherein the diameter of said inner perimeter of said ring panel is less than said tab width, wherein said diameter of said outer perimeter of said ring panel is less than said lower portion width;

a first annular hook and loop fastener mounted on said back surface of said ring panel;

a second annular hook and loop fastener with a size and shape similar to that of both the ring panel and the first hook and loop fastener, the second hook and loop fastener having an adhesive on a first surface thereof which is adhesively attached to the steering column about the ignition switch of the vehicle, the second annular hook and loop fastener further having a second surface for detachable mounting with the first annular hook and loop fastener such that the ignition switch extends through said central hole of said ring panel;

a top panel being generally rectangular having an outer perimeter defining top and bottom edges and a pair of side edges, said outer perimeter of said top panel being coupled to said lower portion outer perimeter of said lower portion of said main panel such that said bottom edge of said top panel is coupled to said bottom end of said main panel and said side edges of said top panel are coupled to their corresponding sides of said lower portion of said main panel;

a pocket being formed between said top panel and said main panel, said top edge of said top panel defining an opening into said pocket, said pocket being for inserting objects therein, wherein said top edge of said top panel is V-shaped having a vertex, wherein said vertex of said V-shaped top edge of said top panel is extended towards said bottom edge of said top panel, said V-shaped top edge of said top panel being for aiding insertion of objects into said pocket.

* * * * *